US007664454B2

(12) United States Patent
Ishikuro

(10) Patent No.: US 7,664,454 B2
(45) Date of Patent: Feb. 16, 2010

(54) IMAGE FORMING APPARATUS

(75) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 236 days.

(21) Appl. No.: 11/320,667

(22) Filed: Dec. 30, 2005

(65) Prior Publication Data

US 2006/0153610 A1 Jul. 13, 2006

(30) Foreign Application Priority Data

Jan. 7, 2005 (JP) ..... 2005-003135

(51) Int. Cl.
*G03G 15/00* (2006.01)
*B65H 85/00* (2006.01)

(52) U.S. Cl. ..... 399/364; 271/270

(58) Field of Classification Search ..... 399/320, 399/322, 324, 361, 363, 364, 381, 394, 395, 399/397, 400, 401, 406; 271/270; *G03G 15/00, G03G 21/00; B65H 82/00, 15/00, 85/00*
See application file for complete search history.

(56) References Cited

U.S. PATENT DOCUMENTS

| | | | | |
|---|---|---|---|---|
| 4,974,828 | A | 12/1990 | Matsuo et al. | |
| 5,345,300 | A * | 9/1994 | Uehara et al. | 399/329 |
| 5,707,612 | A | 1/1998 | Zofchak et al. | |
| 5,920,759 | A * | 7/1999 | Ushiroji et al. | 399/406 |
| 5,972,324 | A | 10/1999 | Zofchak et al. | |
| 6,315,991 | B1 | 11/2001 | Zofchak et al. | |
| 6,392,087 | B1 | 5/2002 | Zofchak et al. | |
| 6,583,106 | B2 | 6/2003 | Zofchak | |
| 6,613,866 | B2 | 9/2003 | Zofchak et al. | |
| 6,626,428 | B2 * | 9/2003 | Soga et al. | 271/182 |
| 6,800,716 | B2 | 10/2004 | Zofchak et al. | |
| 6,881,776 | B2 | 4/2005 | Butuc | |
| 7,146,113 | B2 * | 12/2006 | Kitamura | 399/13 |
| 7,315,705 | B2 * | 1/2008 | Yasui et al. | 399/68 |
| 2002/0064404 | A1 | 5/2002 | Iwai | |
| 2006/0220309 | A1 * | 10/2006 | Igarashi | 271/303 |

FOREIGN PATENT DOCUMENTS

| | | | |
|---|---|---|---|
| CN | 1403882 | A | 3/2003 |
| CN | 1673894 | A | 9/2005 |
| JP | 08113432 | A * | 5/1996 |
| JP | 2001315988 | A * | 11/2001 |
| JP | 2003202715 | A * | 7/2003 |
| JP | 2003-261241 | | 9/2003 |

* cited by examiner

*Primary Examiner*—Judy Nguyen
*Assistant Examiner*—'Wyn' Q Ha
(74) *Attorney, Agent, or Firm*—Rabin & Berdo, P.C.

(57) ABSTRACT

An image forming apparatus includes a medium transporting mechanism. A first transporting section transports a recording medium on which an image is formed. A second transporting section receives the recording medium from the first transporting section and then further transports the recording medium. The second transporting section has a smaller transporting force than the first transporting section. A controller controls the second transporting section in such a way that the second transporting section transports the recording medium at a higher speed than the first transporting section.

8 Claims, 6 Drawing Sheets

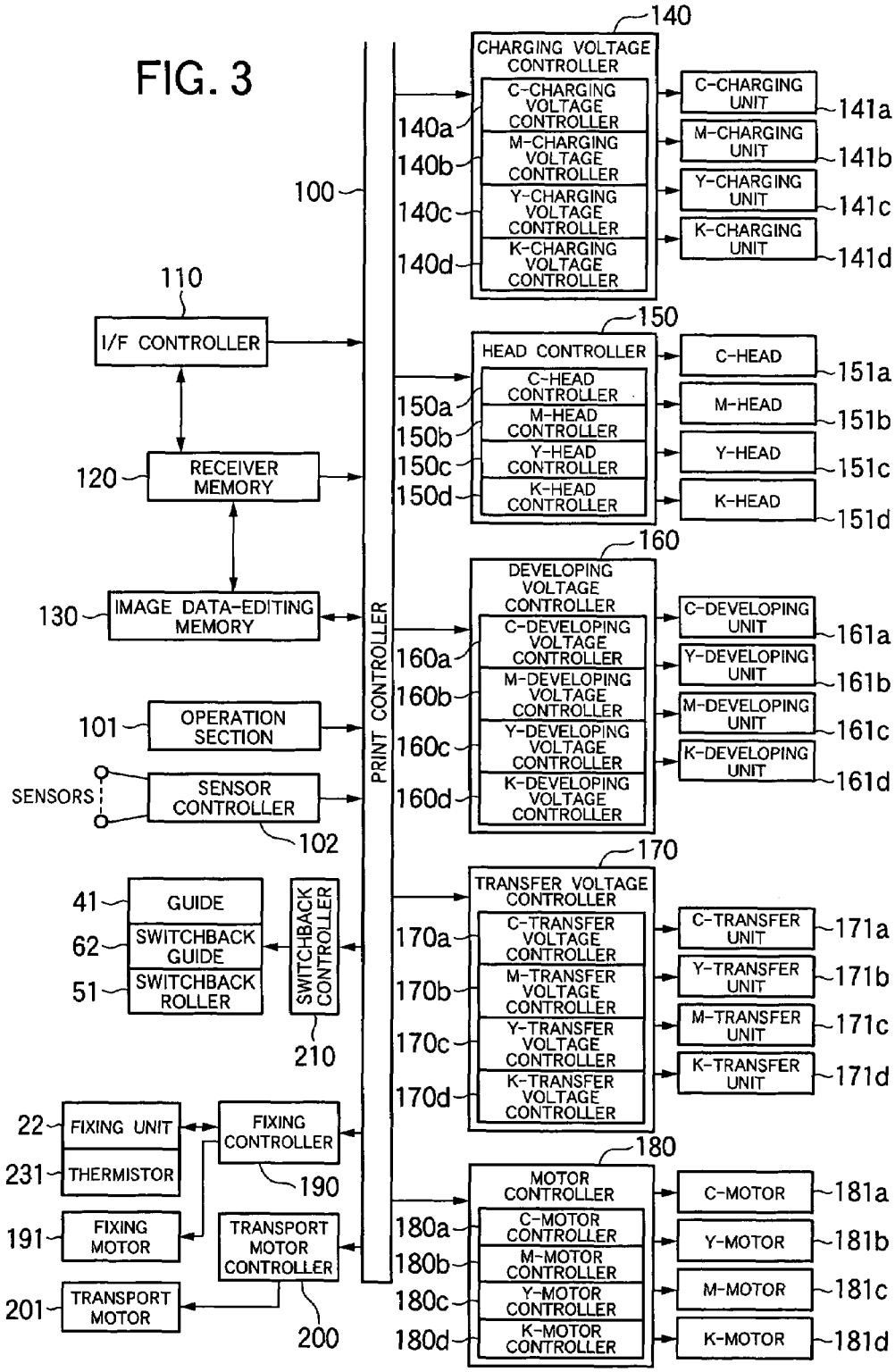
FIG. 3
100
PRINT CONTROLLER
110
I/F CONTROLLER
120
RECEIVER MEMORY
130
IMAGE DATA-EDITING MEMORY
101
OPERATION SECTION
SENSORS
SENSOR CONTROLLER
102
41
GUIDE
62
SWITCHBACK GUIDE
51
SWITCHBACK ROLLER
SWITCHBACK CONTROLLER
210
22
FIXING UNIT
231
THERMISTOR
FIXING CONTROLLER
190
191
FIXING MOTOR
TRANSPORT MOTOR CONTROLLER
201
TRANSPORT MOTOR
200
140
CHARGING VOLTAGE CONTROLLER
140a
C-CHARGING VOLTAGE CONTROLLER
140b
M-CHARGING VOLTAGE CONTROLLER
140c
Y-CHARGING VOLTAGE CONTROLLER
140d
K-CHARGING VOLTAGE CONTROLLER
C-CHARGING UNIT
141a
M-CHARGING UNIT
141b
Y-CHARGING UNIT
141c
K-CHARGING UNIT
141d
150
HEAD CONTROLLER
150a
C-HEAD CONTROLLER
150b
M-HEAD CONTROLLER
150c
Y-HEAD CONTROLLER
150d
K-HEAD CONTROLLER
C-HEAD
151a
M-HEAD
151b
Y-HEAD
151c
K-HEAD
151d
160
DEVELOPING VOLTAGE CONTROLLER
160a
C-DEVELOPING VOLTAGE CONTROLLER
160b
M-DEVELOPING VOLTAGE CONTROLLER
160c
Y-DEVELOPING VOLTAGE CONTROLLER
160d
K-DEVELOPING VOLTAGE CONTROLLER
C-DEVELOPING UNIT
161a
Y-DEVELOPING UNIT
161b
M-DEVELOPING UNIT
161c
K-DEVELOPING UNIT
161d
170
TRANSFER VOLTAGE CONTROLLER
170a
C-TRANSFER VOLTAGE CONTROLLER
170b
M-TRANSFER VOLTAGE CONTROLLER
170c
Y-TRANSFER VOLTAGE CONTROLLER
170d
K-TRANSFER VOLTAGE CONTROLLER
C-TRANSFER UNIT
171a
Y-TRANSFER UNIT
171b
M-TRANSFER UNIT
171c
K-TRANSFER UNIT
171d
180
MOTOR CONTROLLER
180a
C-MOTOR CONTROLLER
180b
M-MOTOR CONTROLLER
180c
Y-MOTOR CONTROLLER
180d
K-MOTOR CONTROLLER
C-MOTOR
181a
Y-MOTOR
181b
M-MOTOR
181c
K-MOTOR
181d

IMAGE FORMING APPARATUS

BACKGROUND OF THE INVENTION

1. Field of the Invention

The present invention relates to an image forming apparatus, and more particularly to an image forming apparatus in which printing is performed while also transporting a recording medium;

2. Description of the Related Art

A conventional image forming apparatus that employs LEDs or laser includes a paper feeding section that feeds pages of paper, image forming sections that form visible images on the pages of paper, a fixing unit that fixes the images to the paper, and a discharging unit that discharges printed paper after fixing. The respective image forming sections operates to advance the page of recording paper at slightly different speeds from one another, thereby ensuring stable print quality.

Japanese Patent Laid-Open No. 2002-179282 discloses one such image forming apparatus. The paper is advanced at increasing lower speed as the paper advances from upstream to downstream, thereby preventing the paper from being pulled excessively taut between adjacent image forming sections.

This image forming apparatus suffers from the following problems. When duplex printing is performed, the paper is not taut enough from when the fixing operation has completed until the paper reaches inversion rollers. Thus, the paper becomes skewed with respect to a transport path when paper is transported in the transport path. The paper is pulled in between the inversion rollers while remaining skewed. The skewed paper is then flipped over and transported further. This causes poor print quality of an image on the back surface of the paper.

SUMMARY OF THE INVENTION

The present invention was made in view of the aforementioned drawbacks of the conventional art.

An object of the present invention is to provide an image forming apparatus in which slack in a printed paper is removed to prevent the paper from becoming skewed from when the paper is discharged from the fixing unit until the paper reaches the transport roller.

An image forming apparatus includes a first transporting section, second transporting section, and controller. The first transporting section transports a recording medium on which an image is formed. The second transporting section receives the recording medium from the first transporting section and then further transports the recording medium, the second transporting section having a smaller transporting force than the first transporting section. The controller that controls the second transporting section in such a way that the second transporting section transports the recording medium at a higher speed than the first transporting section.

The first transporting section and the second transporting section are related such that $$Vf<Vr\leqq 1.05\times Vf$$

where Vr is a transporting speed of the second transporting section and Vf is a transporting speed of the first transporting section.

The first transporting section is a fixing unit that fixes a developer deposited on the recording medium while also transporting the recording medium.

The second transporting section includes an idle roller and a transporting roller that is driven by the controller in rotation, the transporting roller and the idle roller rotating under control of the controller while also holding the recording medium between them in a sandwiched relation, the idle roller rotating in contact with a side of the recording paper on which the image has been formed.

The idle roller is in pressure contact with the transporting roller such that the idle roller and the transporting roller exert a transporting force on the recording medium, the transporting force being not larger than ¼ of a transporting force exerted by the first transporting section on the recording medium.

The second transporting section includes a transporting roller that is driven to rotate in contact with the recording medium under control of the controller, the transporting roller having a surface with a static friction coefficient such that $0.3\leqq\mu\leqq 2.5$ where $\mu$ is the static friction coefficient of the surface of the transporting roller.

The controller controls the second transporting section in such a way that the second transporting section causes the recording medium received from the first transporting section to switch back.

The second transporting section has a smaller transporting force when the recording medium advances in a forward direction before it has switched back than when the recording medium advances in a rearward direction after it has switched back.

The second transporting section includes a switchback roller that rotates in contact with the recording medium under control of the controller;

wherein when the second transporting section causes the recording medium to advance in the forward direction before it has switched back, an area on the switchback roller sanded in a first direction contacts the recording medium;

wherein when the second transporting section causes the recording medium to advance in the rearward direction after it has switched back, an area on the switchback roller sanded in a second direction opposite to the first direction contacts the recording medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 3 is a block diagram illustrating the control of an image forming apparatus according to the first embodiment;

DETAILED DESCRIPTION OF THE INVENTION

Embodiments of the invention will be described in detail with reference to the accompanying drawings.

FIRST EMBODIMENT

{Construction}

Figure 1:
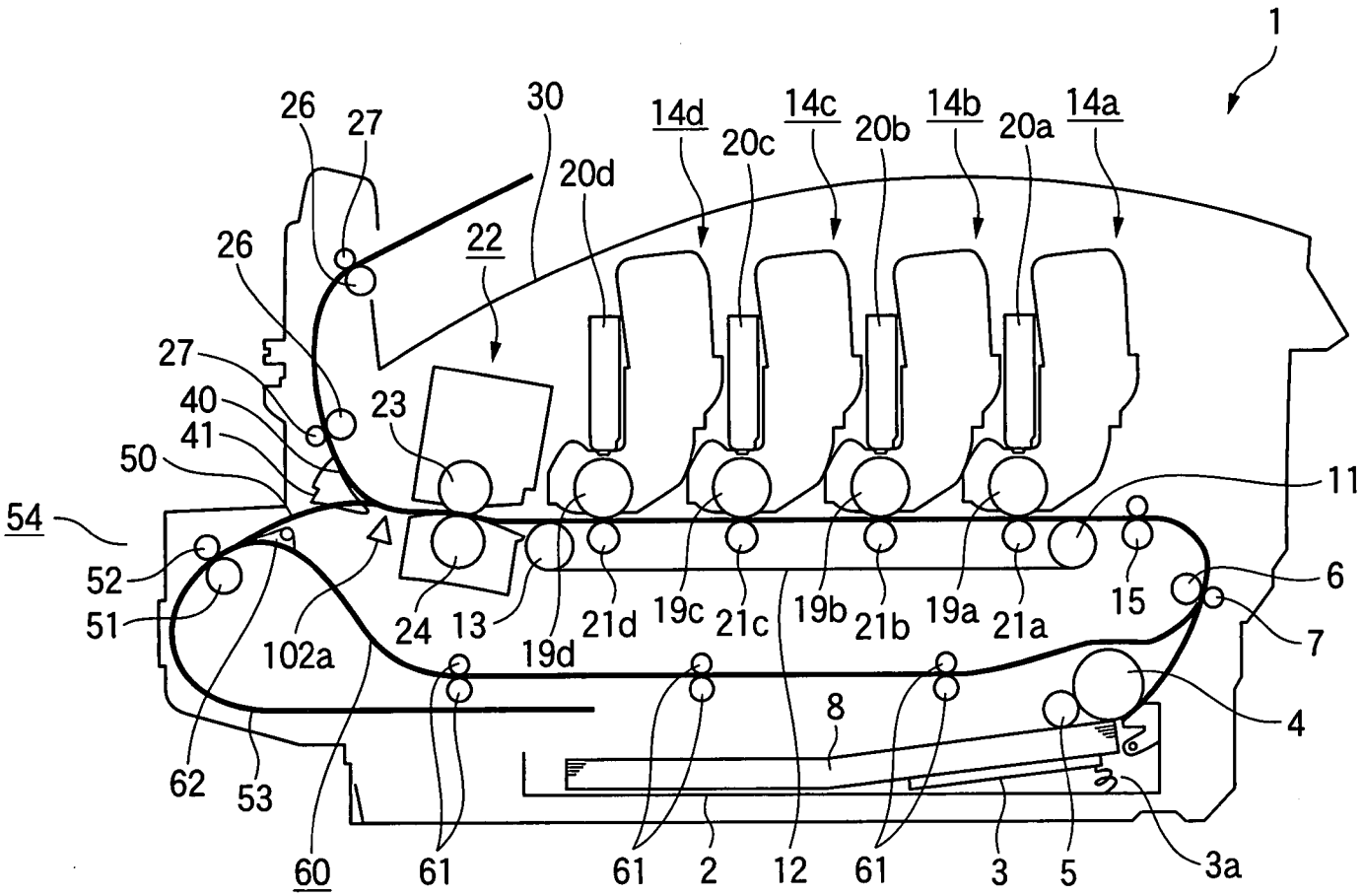
FIG. 1 is a schematic elevation view illustrating an image forming apparatus according to a first embodiment.

FIG. 1 is a schematic elevation view illustrating an image forming apparatus according to a first embodiment. An image forming apparatus 1 includes a paper cassette 2, sheet support platform 3, feeding roller 4, sub-feeding roller 5, drive roller 6, and idle roller 7. The paper cassette 2 holds a stack of paper 8. A spring 3*a* urges the sheet supporting platform 3 upwardly so that the top page of the stack of the paper 8 is in pressure contact with the feeding roller 4. The feed roller 4 and sub-feeding roller 5 are driven by a drive source, not shown, in rotation to feed the top page of the stack of the paper 8 to the drive roller 6 and idle roller 7. When the drive roller 6 rotates, the drive roller 6 cooperates with the idle roller 7 to hold a page of paper 8 between them to further advance the paper 8 to image forming sections 14*a*-14*d*.

The image forming unit 10 includes the following structural members: a belt-driving roller 11, idle roller 13, transport belt 12, and image forming sections 14*a*-14*d*. A transport belt 12 is entrained about a belt-driving roller 11 and an idle roller 13. The belt-driving roller 11 cooperates with the idle roller 13 to maintain the transport belt 12 taut. When the belt-driving roller 11 is rotated, the transport belt 12 is driven to run. The image forming sections 14*a*-14*d* form electrostatic latent images of cyan, magenta, yellow, and black, and develop the electrostatic latent images into cyan, magenta, yellow, and black toner images, respectively.

Transfer rollers 21*a*-21*d* are disposed with the transport belt 12 sandwiched between the transfer rollers 21*a*-21*d* and photoconductive drums 19*a*-19*d*. A bias voltage is applied to the photoconductive drums 19*a*-19*d*, and a bias voltage of the opposite polarity to that of the bias voltage applied to the photoconductive drums 19*a*-19*d* is applied to the transfer rollers 21*a*-21*d*. LED heads 20*a*-20*b* illuminate the charged surfaces of the photoconductive drums 19*a*-19*d* in accordance with print data to form electrostatic latent images on the photoconductive drums 19*a*-19*d*, and the photoconductive drums 19*a*-19*d* hold toner images of the respective colors formed on them.

A fixing unit 22 is disposed downstream of the image forming section 14*d*. The fixing unit 22 includes a heat roller 23 rotated by a fixing motor 191 (FIG. 3) and a pressure roller 24. The heat roller 23 and pressure roller 24 rotate while also holding the paper 8 therebetween, thereby applying heat and pressure to the toner image on the paper to fix the toner image into a permanent image. A discharge path 40 is provided downstream of the fixing unit 22. The discharge unit 40 includes a discharge roller 26 and an idle roller 27. The discharge roller 26 is driven in rotation by the fixing motor 191. The paper 8 is advanced through the discharge path 40 and is discharged face down onto a stacker 30. A switchback path 53 is also immediately downstream of the fixing unit 22. A guide 41 is located downstream of the fixing unit 22 and is controlled by a solenoid, not shown, under the control of a print controller 100, which will be described later, thereby directing the fixed paper 8 into either the discharge path 40 or the switchback path 53.

The pressure roller 24 and the fixing roller 23 are in pressure contact with each other under a pressing force Pf of about 20 kgf. The static friction coefficient μh between the paper 8 and the fixing roller 23 is about 0.3 (for ordinary paper). The static friction coefficient pp between the pressure roller 24 and the paper 8 is about 0.3 (for ordinary paper). Both the fixing roller 23 and the pressure roller 24 are coated with fluoroplastic or covered with a tube made of fluoroplastic so that these rollers have a good releasing property. Thus, a transporting force Tf at the fixing unit is given by the following relation.

$$\begin{aligned} Tf &= \mu h \cdot Pf + \mu p \cdot Pf \\ &= 0.3 \times 20 + 0.3 \times 20 \\ &= 12.0 \text{ kg}f \end{aligned}$$

Figure 2:
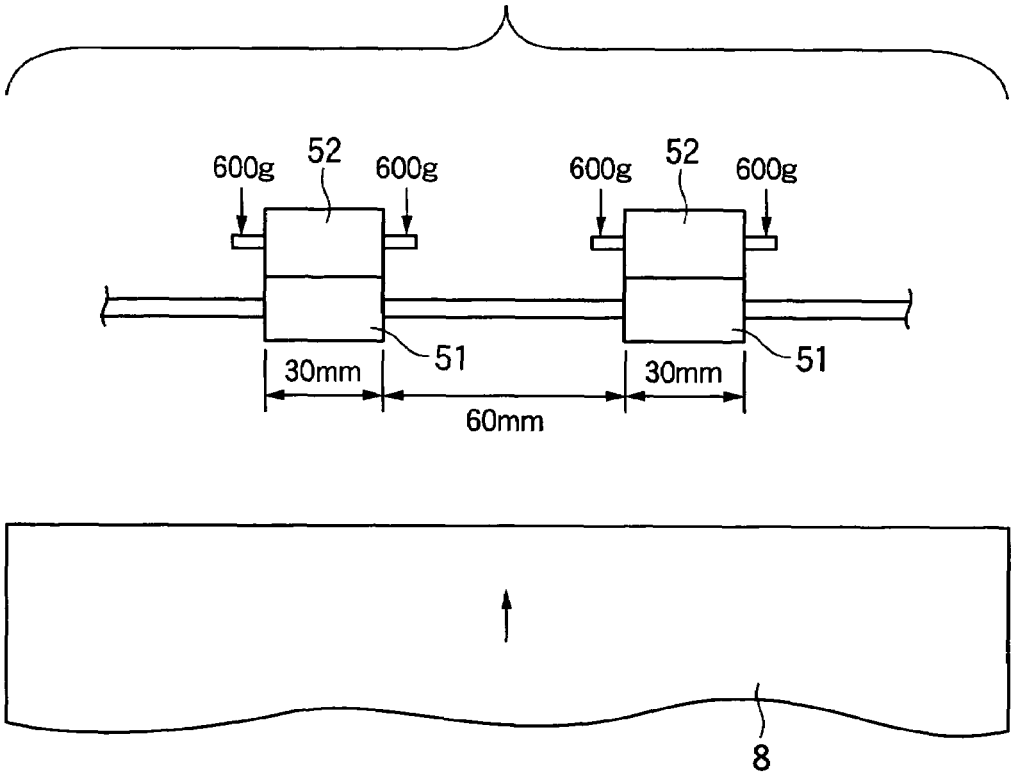
FIG. 2 is a front view of switchback rollers and idle rollers.

FIG. 2 is a front view of switchback rollers 51 and idle rollers 52 disposed at two locations in their axial directions.

The switchback mechanism 54 is constructed of the switchback rollers 51, the idle rollers 52, a switchback path 53, and a switchback guide 62. The switchback roller 51 and idle roller 52 cooperate with each other to advance the paper 8 into and out of the switchback path 53. The switchback guide 62 is driven by the solenoid under the control of the print controller 100 (FIG. 3) to first direct the paper 8 into the switchback path 53, and then into a transporting mechanism 60, thereby causing the paper 8 to switch back. A transporting mechanism 60 is disposed downstream of the switchback mechanism 54, and includes a plurality of transport rollers 61. The transport rollers 61 transport the paper 8 back to an upstream end of the image forming section 14*a*.

The switchback roller 51 has a surface formed of, for example, ethylene-propylene rubber. The static friction coefficient μr between the paper 8 and surface of the switchback roller 51 is preferably about 1.3. The idle roller 52 opposes the switchback roller 51 and is fixed to a solenoid, not shown. When the solenoid is energized, each of the idle rollers 52 are pressed against a corresponding one of the switchback rollers 51 under a pressure force Pr of about 1.2 kgf. The idle roller 52 is formed of, for example, polyacetal. The static friction coefficient μi between the paper 8 and the surface of the idle roller 52 is preferably about 0.05. A transporting force Tr at the switchback roller 51 is given by the following relation.

$$\begin{aligned} Tr &= (\mu r \cdot Pr - \mu i \cdot Pr) \times 2 \\ &= (1.3 \times 1.2 - 0.05 \times 1.2) \times 2 \\ &= 3.0 \text{ kg}f \end{aligned}$$

The quantity μi·Pr is smaller than the quantity μr·Pr. The quantity μi·Pr retards the travel of the paper 8. Because two roller pairs are employed in FIG. 2, the overall transporting force Tr is given by subtracting μi·Pr from μr·Pr and then multiplying by 2.

As described previously, the transporting force Tf at the fixing unit is 12.0 kgf, and the transporting force Tr at the switchback roller 51 is 3.0 kgf. Thus, Tr is ¼ of Tf.

The switchback roller 51 and idle roller 52 may be positioned relative to each other such that the switchback roller 51 contacts the image side of the paper 8, or such that the idle roller 52 contacts the image side of the paper 8. For miniaturized image forming apparatuses, the paper is subject to more stress when it is transported in the apparatus and the switchback roller 51 advances the paper over a shorter distance. For high-speed image forming apparatuses, the fixing unit 22 is set to a higher temperature. Thus, for miniaturized high-speed image forming apparatuses, the paper may be pulled in between the switchback roller 51 and idle roller 52 while it is still hot. Thus, the switchback roller 51 and idle roller 52 are preferably be positioned relative to each other such that the idle roller 52 contacts the image side of the paper 8 with least frictional force not to scratch the image formed on the paper 8.

{Control of Overall Operation}

FIG. 3 is a block diagram illustrating the overall control of the image forming apparatus 1 according to the first embodiment. A print controller 100 controls the overall printing operation of the image forming apparatus 1. A user operates the image forming apparatus 1 through an operation section 101. Sensors detect the position of paper, temperatures, and humidity within the image forming apparatus 1. An interface controller (I/F controller) 110 receives image information from an external apparatus. The image information received through the I/F controller 110 is stored into a receiver memory 120. An image data-editing memory 130 converts the image data in the receiver memory 120 into a plurality of items of binary image information corresponding to individual color developers held in the image forming apparatus 1. A charging voltage controller 140 controls the supply of power to the photoconductive drums 19*a*-19*d*. A head controller 150 controls the LED heads 20*a*-20*d* to illuminate the charged surfaces of the photoconductive drums 19*a*-19*d* in accordance with image information to form electrostatic latent images on the photoconductive drums 19*a*-19*d*, respectively. A developing voltage controller 160 controls a C-developing unit 161*a*, M-developing unit 161*b*, Y-developing unit 161*c*, and K-developing unit 161*d* to cause developers of the respective colors to be charged so that each developer adheres to an electrostatic latent image of a corresponding color formed on a corresponding photoconductive drum. A transfer voltage controller 170 controls the supply of voltage to the transfer rollers 21. A C-motors 181*a*, M-motor 181*b*, Y-motor 181*c*, and K-motor 181*d* drive the photoconductive drums 19*a*-19*d* and transfer rollers 21*a*-21*d*, respectively, in rotation. A transport motor controller 200 controls a transport motor 201 that drives, for example, the transport roller 61. A switchback controller 210 controls the guide 41 and switchback guide 62 via solenoids, not shown.

Upon receiving image information for simplex printing from an external apparatus, not shown, the I/F controller 110 transmits the image information to the receiver memory 120, and notifies the print controller 100 of the reception of the image information.

Upon receiving the notification that the image forming apparatus has received the image information, the print controller 100 notifies the image data-editing memory 130, charging voltage controller 140, head controller 150, developing voltage controller 160, motor controller 180, fixing controller 190, transport motor controller 200, and switchback controller 210 of the reception of the image information. In response to the notification, the charging voltage controller 140, head controller 150, developing voltage controller 160, transfer voltage controller 170, motor controller 180, fixing controller 190, transport motor controller 200, and switchback controller 210 start preparatory operations.

Upon receiving the notification from the print controller 100, the image data-editing memory 130 obtains the image information from the receiver memory 120 and then converts the image information into binary image information that can be interpreted by the head controller 150. Then, the image data-editing memory 130 transmits the binary image information to the print controller 100.

Upon receiving the notification from the print controller 100, the charging voltage controller 140 transmits commands to a C-charging voltage controller 140*a*, M-charging voltage controller 140*b*, Y-charging voltage controller 140*c*, and K-charging voltage controller 140*d* to send electric power to the C-charging unit 141*a*, M-charging unit 141*b*, Y-charging unit 141*c*, and K-charging unit 141*d*, respectively.

Upon receiving the notification from the print controller 100, the developing voltage controller 160 transmits commands to a C-developing voltage controller 160*a*, M-developing voltage controller 160*b*, Y-developing voltage controller 160*c*, and K-developing voltage controller 160*d* to send electric power to the C-developing unit 161*a*, M-developing unit 161*b*, Y-developing unit 161*c*, and K-developing unit 161*d*, respectively.

Upon receiving the notification from the print controller 100, the transfer voltage controller 170 transmits commands to a C-transfer voltage controller 170*a*, M-transfer voltage controller 170*b*, Y-transfer voltage controller 170*c*, and K-transfer voltage controller 170*d* to send electric power to a C-transfer unit 171*a*, M-transfer unit 171*b*, Y-transfer unit 171*c*, and K-transfer unit 171*d*, respectively.

Upon receiving the notification from the print controller 100, the motor controller 180 transmits commands to a C-motor controller 180*a*, M-motor controller 180*b*, Y-motor controller 180*c*, and K-motor controller 180*d* to send electric power to a C-motor 181*a*, M-motor 181*b*, Y-motor 181*c*, and K-motor 181*d*, respectively.

Upon receiving the notification from the print controller 100, the fixing controller 190 starts to energize the heat roller 23 and waits for the output from a thermistor 231 indicating that the heat roller 23 has been heated to a predetermined temperature. When the fixing controller 190 receives the output indicating that the heat roller 23 has reached the predetermined temperature, the fixing controller 190 drives the heat roller 23 to rotate to transport the paper 8.

Upon receiving the notification from the print controller 100, the transport motor controller 200 causes the feed roller 4, registration roller 6, discharging roller 26, and transport roller 61 to rotate. Upon receiving the notification from the print controller 100, the switchback controller 210 causes the solenoid to orient the guide 41 downward (FIG. 4, dotted line) so that the paper 8 is directed into the discharge path 40.

The print controller 100 reads the image information for individual colored developers from the image data-editing memory 130, and then sends the image information to the head controller 150. The head controller 150 in turn sends the received image information to corresponding ones of the C-head controller 150*a*, M-head controller 150*b*, Y-head controller 150*c*, and K-head controller 150*d*. In other words, the respective head controllers 150*a*-150*d* receive image information that correspond to the colors of the developers held in the image forming sections 14*a*-14*d*, respectively.

For example, the C-head controller 150*a* receives the binary image information for cyan, and sends the binary image information to the C-head 20*a*. The C-head controller 150*a* drives an exposing means such as an LED head to form an electrostatic latent image on the surface of the photoconductive drum 19*a*, the electrostatic latent image being formed in timed relation with the paper 8 transported thereto. Then, the cyan developer is deposited to the electrostatic latent image to form a cyan toner image. The cyan toner image is then transferred by the C-transfer unit 171*a* onto the paper 8. These series of operations are performed in the respective image forming sections 14c-14d so that the toner images of the respective colors are transferred onto the paper 8 one over the other in registration.

The paper 8 transported to the fixing unit 22 is further transported by the heat roller 23 that has been heated to the predetermined temperature. The heat roller 23 and pressure roller 24 cooperate with each other to transport the paper 8 while also holding the paper between the heat roller 23 and pressure roller 24 in a sandwiched relation. At this moment, the toner images of the respective colors on the paper 8 are fused by the heat supplied from the heat roller 23 into a full color permanent image. Then, the paper 8 is discharged from the fixing unit 22, and is further transported by the discharge roller 26 and idle roller 27 to the stacker 30 face down.

{Switchback Mechanism}

Figure 4:
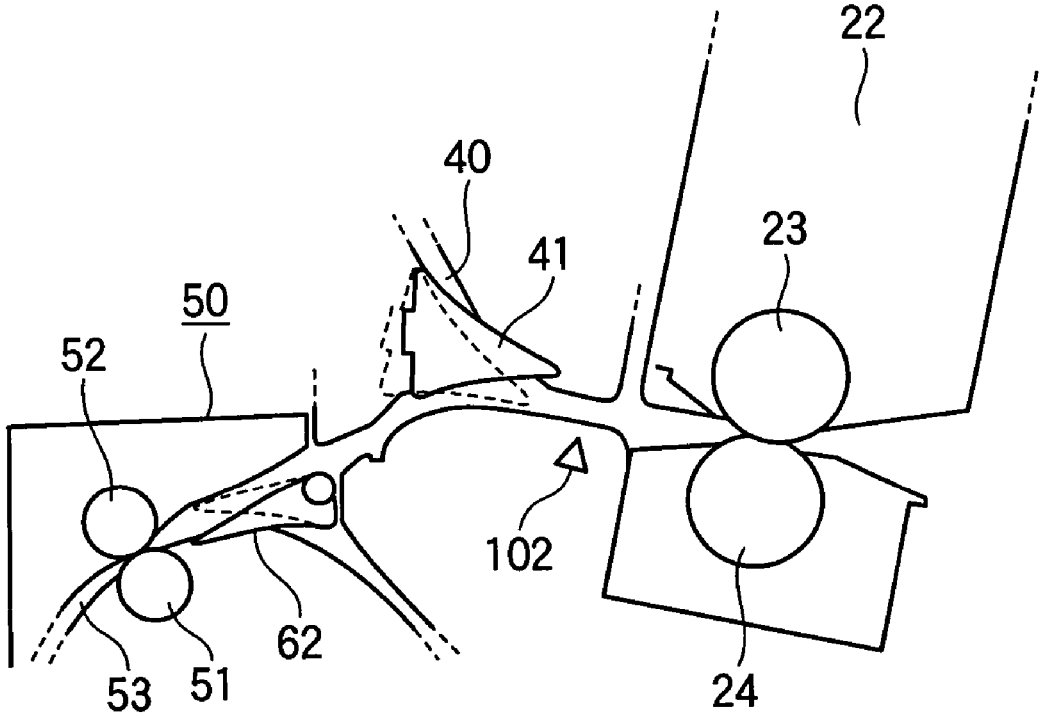
FIG. 4 is a side view of the vicinity of a fixing unit, discharge path, and switchback mechanism.

FIG. 4 is a side view of the fixing unit 22, discharge path 40, and switchback mechanism 54.

For simplex printing, the paper 8 is fed from the paper cassette 2 to the image forming sections 14a-14d. Toner images of the respective colors are formed on the paper 8 as described above and the paper 8 is transported to the fixing unit 22 where the toner images of the respective colors on the paper 8 are fixed into a permanent image. Then, the paper 8 is discharged from the fixing unit 22. A sensor 102a detects the leading end of the paper 8, and sends a detection signal to the printing controller 100. In response to the detection signal, the printing controller 100 stops supply of electric power to the solenoid, so that the solenoid causes the guide 41 to orient downward (dotted line) to direct the paper 8 into the discharge path 40.

For duplex printing, the paper 8 is fed from the paper cassette 2 to the image forming sections 14a-14d in the same manner as in simplex printing. Toner images of the respective colors are formed on the paper as described above and the paper 8 is transported to the fixing unit 22 where the toner image on the paper 8 is fixed into a permanent image. Then, the paper 8 is discharged from the fixing unit 22. At this moment, the sensor 102a (FIG. 1 and FIG. 4) detects the leading end of the paper 8, and sends a detection signal to the print controller 100. In response to the detection signal, the print controller 100 supplies electric power to the solenoid, so that the solenoid causes the guide 41 to orient upward (solid line) to direct the paper 8 into the switchback path 53. The switchback guide 62 is oriented downward (solid line) to guide the paper 8 to the switchback roller 51 and idle roller 52, which in turn cooperate to advance the paper 8 into the switchback path 53.

When the paper 8 has entered sufficiently into the switchback path 53, a sensor, not shown, detects the trailing end of the paper 8. The output of the sensor is transmitted to the print controller 100 through the sensor controller 102. Then, the print controller 100 controls the switchback controller 210 to stop a drive source, not shown, which is driving the switchback roller 51, thereby stopping the supply of electric power to the solenoid. Thus, the solenoid causes the guide 41 to orient downward (dotted line) and the switchback guide 62 to orient upward (dotted line). Then, the print controller 100 controls the switchback controller 210 to drive the switchback roller 51 to rotate in the opposite direction, so that the switchback roller 51, idle roller 52 and switchback guide 62 cooperate to advance the paper 8 toward the transporting mechanism 60.

The paper 8 is transported by the transporting mechanism 60 to the upstream end of the image forming section 14a. Thereafter, the paper 8 passes through the image forming sections 14a-14d and the fixing unit 22 so that a full color image is formed on the back side of the paper 8.

After fixing the toner images of the respective colors on the backside of the paper 8, the paper 8 is discharged from the fixing unit 22. The sensor 102a detects the leading end of the paper 8 and sends a detection signal to the print controller 100. In response to the detection signal, the printing controller 100 stops supply of electric power to the solenoid, so that the solenoid causes the guide 41 to orient downward (FIG. 4, dotted line) to direct the paper 8 into the discharge path 40. Then, the paper 8 is discharged to the stacker 30.

{Speeds of Fixing Roller and Switchback Roller}

The print controller 100 controls the heat roller 23 to rotate at a circumferential speed Vf. Thus, the paper 8 advances at the circumferential speed Vf. When the leading end of the paper 8 reaches the switchback roller 51, the leading end is not quite parallel to a rotational axis of the switchback roller 51 due to the fact that some load exerted on the paper 8 has caused some slack in the paper. Thus, the paper 8 is transported while remaining skewed with respect to the transport path.

The print controller 100 controls the switchback roller 51 to rotate at the circumferential speed Vr higher than Vf. Therefore, the paper 8 is pulled in between the switchback roller 51 and the idle roller 52 while also remaining skewed. The difference between the circumferential speeds Vr and Vf causes the paper 8 to become excessively taut between the switchback roller 51 and the heat roller 23. The transporting force Tr exerted on the paper 8 by the switchback roller 51 is smaller than the transporting force Tf exerted on the paper 8 by the heat roller 23, causing the leading end portion of the paper to slip on the switchback roller 51. This slippage of the leading end portion of the paper 8 is effective in gradually removing the skew of the paper 8. In this manner, the skew would be completely removed eventually by the time the trailing end of the paper 8 leaves the heat roller 23.

Experiment was conducted to determine the following relation.

$$0.3 \leqq \mu r \leqq 2.5 \qquad \text{Eq. 1}$$

where μr is the static friction coefficient between the paper 8 and switchback roller 51. As is clear from Equation 1, the static friction coefficient μr between the paper 8 and switchback roller 51 varies depending on the type of the paper 8. The substantially the same relation as Equation 1 holds for the heat roller 23 and the paper 8, so that the transporting force Tr at the switchback roller 51 is ¼ of the transporting force Tf at the heat roller 23.

$$Vr \leqq 1.05 \times Vf \qquad \text{Eq. 2}$$

where Vr is the circumferential speed of the switchback roller 51 and Vf is the circumferential speed of the heat roller 23.

As described previously, the transporting force Tf at the fixing unit is 12.0 kgf, and the transporting force Tr at the switchback roller 51 is 3.0 kgf. The transporting forces Tr and Tf are preferably selected such that $Tr \leqq (1/4) \times Tf$.

After the skew has been removed, the paper 8 is directed by the switchback roller 51 and idle roller 52 into the switchback path 53, and is then transported by the transporting mechanism 60 to the upstream end of the image forming section 14a. Thereafter, the paper 8 again passes through the image forming sections 14a-14d and the fixing unit 22, so that a full color image is formed on the back side of the paper 8. Then the paper 8 is discharged to the stacker 30.

Printing the image information on the both sides of the paper 8 in the aforementioned manner prevents the paper 8 from being damaged by the force that acts on the paper 8 between the switchback roller 51 and heat roller 23, and ensures high print quality.

As described above, the switchback roller 51 contacts the back side of the paper 8 in which no image has been formed yet, and the idle roller 52 contacts the front side of the paper 8 on which an image has been fixed. Thus, no mark of slippage is left on the paper 8, ensuring high print quality.

SECOND EMBODIMENT

An image forming apparatus according to a second embodiment has the same configuration as that of the first embodiment. Elements similar to those in the first embodiment have been given the same reference numerals, and the description thereof is omitted.

Figure 5:
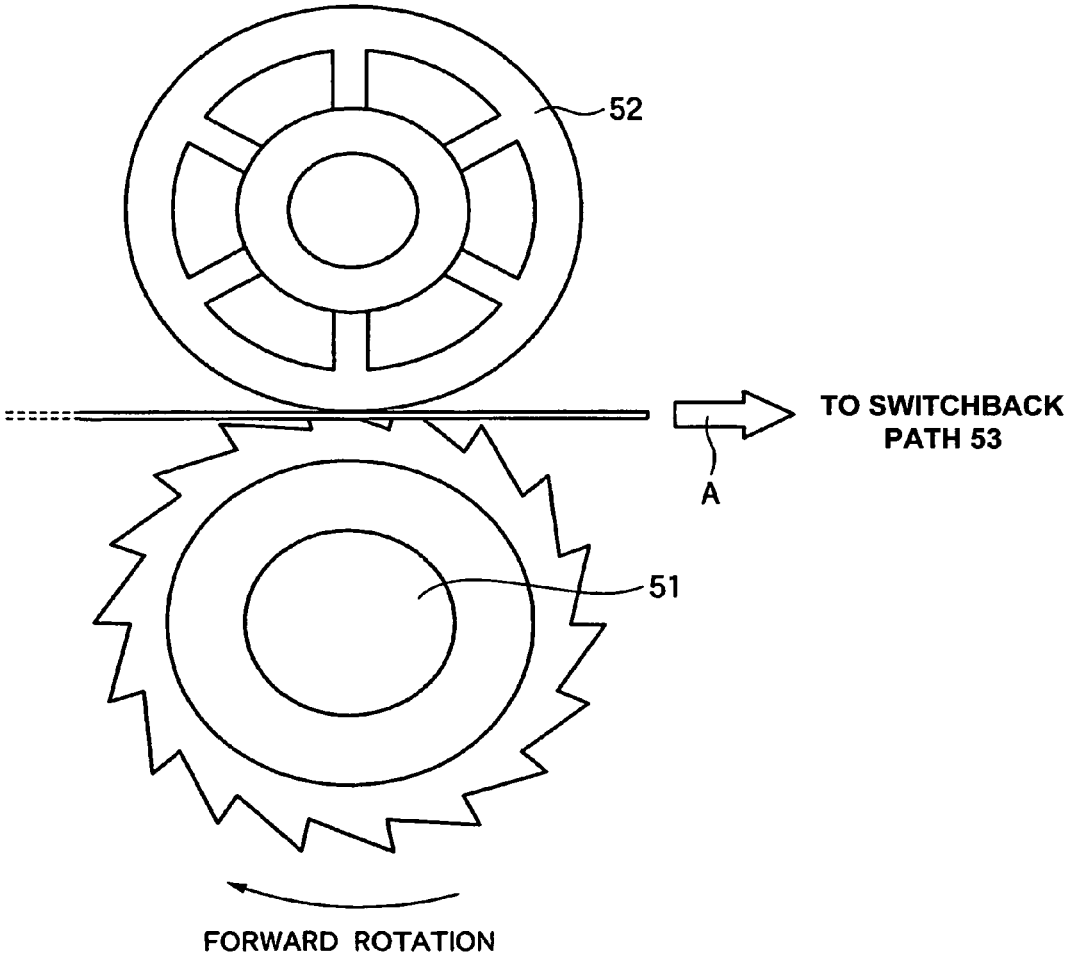
FIGS. 5 and 6 are front views illustrating the vicinity of switchback rollers of an image forming apparatus according to a second embodiment.
Figure 6:
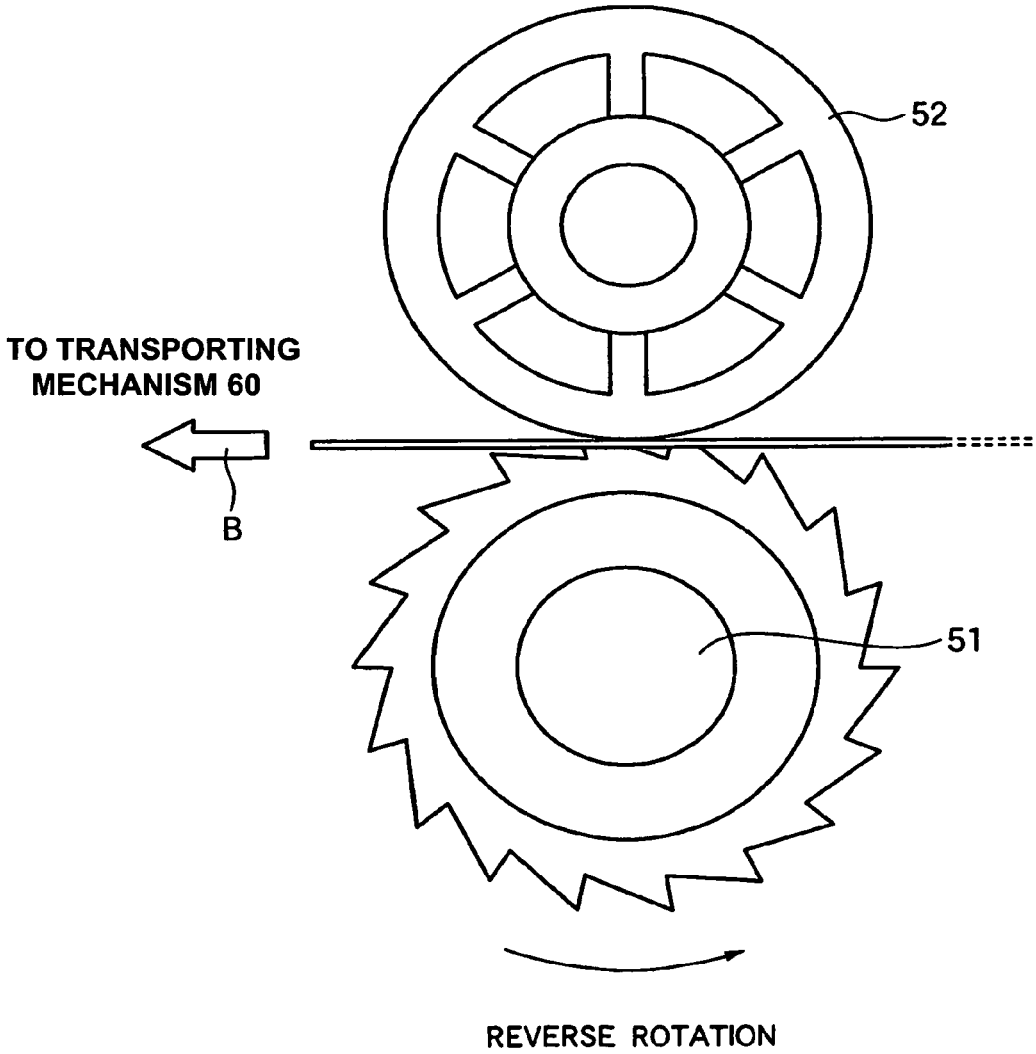

FIGS. 5 and 6 are front views illustrating the vicinity of a switchback roller 51 and an idle roller 52 of the image forming apparatus according to the second embodiment. The surface of the switchback roller 51 is formed of a rubber material such as ethylene-propylene. One way of forming a member from rubber is to cut and carve a block into a specific shape (e.g., roller) by using a special mold. Such a way of forming a rubber member or roller leaves burrs along the parting lines. In order to remove the burrs, a grinding means such as a rotating sander may be used to carve the roller to a desired outer diameter. The sanded area of the roller may differ for the burrs projecting in the direction of rotation of the roller and the burrs projecting in the opposite direction, and therefore creates a difference in area of the roller in contact with the paper 8. Specifically, the area sanded in the direction of rotation of the roller is larger than that sanded in the opposite direction. A frictional force is a product of a force normal to a surface and the static friction coefficient of the surface. Thus, the area sanded in the direction of rotation of the roller is larger than that sanded in the opposite direction, and creates a larger friction force.

Therefore, the switchback roller 51 is disposed in the following manner. When the paper 8 is directed from the fixing unit 22 into the switchback path 53 as shown in FIG. 5, the switchback roller 51 is rotated in the forward direction. When the paper 8 is directed from the switchback roller 51 into the transporting mechanism 60 as shown in FIG. 6, the switchback roller 51 is rotated in the reverse direction in which a larger friction force is required. Arranging the switchback roller 51 in this manner provides a desired transporting force.

Experiment reveals that the following relation must be satisfied to prevent the paper 8 from becoming skewed.

$$0.3 \leqq \mu_2 \leqq \mu_1 \leqq 2.5$$

$\mu_2$ is a static friction coefficient of the surface of the switchback roller 51 sanded in a first direction in which the surface of the switchback roller 51 contacts the recording medium when the recording medium is transported in a forward direction, before the recording medium has switched back, and $\mu_1$ is a static friction coefficient of the surface of the switchback roller 51 sanded in a second direction opposite to the first direction, in which the surface of the switchback roller 51 contacts the recording medium when the recording medium is transported in a rearward direction, after the recording medium has switched back.

While the aforementioned embodiments have been described with respect to image forming apparatuses that employ an LED head, the present invention may also be applicable to image forming apparatuses such as ink jet printers, thermal printers, and dot impact printers. Although the invention has been described in terms of a means for eliminating skew of the paper 8 in a duplex printing mechanism, the invention is not limited to the duplex printing mechanism, and may be applied to, for example, an apparatus where a cutting mechanism is employed and skew errors of a material to be cut is a primary concern.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus comprising:

a first transporting section that transports a recording medium on which an image is formed;

a second transporting section that receives the recording medium from said first transporting section and then further transports the recording medium, said second transporting section having a smaller transporting force than said first transporting section, wherein said second transporting section includes a pair of rollers that transports the recording medium such that the pair of rollers is less slippery on the recording medium when transporting the recording medium in a rearward direction than when transporting the recording medium in a forward direction, said pair of rollers comprises at least one roller formed obliquely in only one direction;

a controller that controls said second transporting section such that said second transporting section transports the recording medium at a higher speed than said first transporting section, and that said second transporting section causes the recording medium received from said first transporting section to switch back.

2. The image forming apparatus according to claim 1, wherein said first transporting section and said second transporting section are related such that $$Vf < Vr \leqq 1.05 \times Vf$$

where Vr is a transporting speed of said second transporting section and Vf is a transporting speed of said first transporting section.

3. The image forming apparatus according to claim 1, wherein said first transporting section is a fixing unit that fixes a developer deposited on the recording medium while also transporting the recording medium.

4. The image forming apparatus according to claim 1, wherein the pair of rollers includes an idle roller and a transporting roller that is driven by said controller in rotation, the transporting roller and the idle roller rotating under control of said controller while also holding the recording medium between them in a sandwiched relation, said idle roller rotating in contact with a side of the recording paper on which the image has been formed.

5. The image forming apparatus according to claim 4, wherein the idle roller is in pressure contact with the transporting roller such that the idle roller and the transporting roller exert a transporting force on the recording medium, the transporting force being not larger than ¼ of a transporting force exerted by said first transporting section on the recording medium.

6. The image forming apparatus according to claim 1, wherein said second transporting section has a smaller transporting force when the recording medium advances in the forward direction before it has switched back than when the recording medium advances in the rearward direction after it has switched back.

7. The image forming apparatus according to claim 6, said second transporting section includes a switchback roller that rotates in contact with the recording medium under control of said controller;

wherein when said second transporting section causes the recording medium to advance in the forward direction before it has switched back, an area on the switchback roller sanded in a first direction contacts the recording medium;

wherein when said second transporting section causes the recording medium to advance in the rearward direction after it has switched back, an area on the switchback roller sanded in a second direction opposite to the first direction contacts the recording medium.

8. The image forming apparatus according to claim 1, wherein at least one roller of the pair of rollers is driven to rotate in contact with the recording medium, at least one roller including a surface having a static friction coefficient such that $$0.3 \leqq \mu_2 \leqq \mu_1 \leqq 2.5$$

where $\mu_2$ is a static friction coefficient of the surface when the recording medium is transported in a forward direction, and $\mu_1$ is a static friction coefficient of the surface when the recording medium is transported in a rearward direction.

* * * * *